US008098831B2

(12) United States Patent
Rubio et al.

(10) Patent No.: US 8,098,831 B2
(45) Date of Patent: Jan. 17, 2012

(54) VISUAL FEEDBACK IN ELECTRONIC ENTERTAINMENT SYSTEM

(75) Inventors: Vasco Rubio, Edmonds, WA (US); Eric Filer, Renton, WA (US); Loren Douglas Reas, Kent, WA (US); Dennis W Tom, Redmond, WA (US)

(73) Assignee: Microsoft Corporation, Redmond, WA (US)

( * ) Notice: Subject to any disclaimer, the term of this patent is extended or adjusted under 35 U.S.C. 154(b) by 916 days.

(21) Appl. No.: 12/121,180

(22) Filed: May 15, 2008

(65) Prior Publication Data

US 2009/0284950 A1 Nov. 19, 2009

(51) Int. Cl.
*H04R 29/00* (2006.01)

(52) U.S. Cl. ..... 381/56; 381/57; 381/59; 381/61; 381/124

(58) Field of Classification Search ..... 381/56, 381/57, 59, 61, 124
See application file for complete search history.

(56) References Cited

U.S. PATENT DOCUMENTS

| | | | |
|---|---|---|---|
| 5,289,355 | A | 2/1994 | Cimock |
| 6,164,792 | A | 12/2000 | Nakagome |
| 6,364,509 | B1 | 4/2002 | Johnson |
| 6,522,761 | B1 | 2/2003 | Ruffa |
| 6,690,804 | B2 | 2/2004 | Everett |
| 7,271,329 | B2 | 9/2007 | Franzblau |
| 7,306,347 | B2 | 12/2007 | Selover |
| 7,317,808 | B2 | 1/2008 | Niehoff |
| 2003/0112984 | A1 | 6/2003 | Graumann |
| 2005/0288731 | A1 | 12/2005 | Shames et al. |
| 2006/0222185 | A1 | 10/2006 | Dyer et al. |

FOREIGN PATENT DOCUMENTS

| | | | |
|---|---|---|---|
| JP | 2004061968 | A | 2/2004 |
| JP | 2005189658 | A | 7/2005 |
| KR | 20070063393 | A | 6/2007 |

OTHER PUBLICATIONS

Levin, et al., "In-Situ Speech Visualization in Real-Time Interactive Installation and Performance", Proceedings of the 3rd International Symposium on Non-photorealistic Animation and Rendering, ACM, 2004, pp. 7.

ISA Korea, International Serch Report of PCT/US2009/040856, Oct. 30, 2009, 3 pages.

*Primary Examiner* — Tan N Tran
(74) *Attorney, Agent, or Firm* — Alleman Hall McCoy Russell & Tuttle LLP

(57) ABSTRACT

The presentation of visual feedback in an electronic entertainment system is disclosed. One disclosed embodiment relates to a method of providing user feedback in an electronic entertainment system, wherein the method comprises inviting an input from a user, receiving a user input via a hand-held remote input device, performing a comparison of the user input received to an expected input, assigning a rating to the user input received based upon the comparison to the expected input, and adjusting light emitted by one or more lights sources on the input device based upon the rating.

12 Claims, 3 Drawing Sheets

VISUAL FEEDBACK IN ELECTRONIC ENTERTAINMENT SYSTEM

BACKGROUND

Electronic entertainment systems, such as video games, generally provide user feedback in a number of different forms. For example, many video games are configured to provide feedback to a user input by displaying motion on a display screen and/or by emitting sounds via one or more speakers. Further, a score or other such performance metric may be displayed to give the user feedback regarding how well the user played the game. This may provide a basis for the user to track improvements in skill, and to compare the user's skill to the skill of other players.

However, other entertainment systems may not be configured to offer such feedback to a user. For example, karaoke systems may be configured to prompt a user to sing into a microphone along with a song (for example, via lyrics displayed on a display), and then to amplify and output the user's singing for an audience to hear. In such systems, feedback on the performance may provided by the audience (for example, via cheering or booing), rather than the entertainment system.

SUMMARY

Accordingly, various embodiments related to the presentation of visual feedback in an electronic entertainment system are disclosed herein. For example, one disclosed embodiment relates to a method of providing user feedback in an electronic entertainment system. The method comprises inviting an input from a user, receiving a user input via a hand-held remote input device, performing a comparison of the user input received to an expected input, assigning a rating to the user input received based upon the comparison to the expected input, and adjusting light emitted by one or more light sources in the hand-held remote input device based upon the rating.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
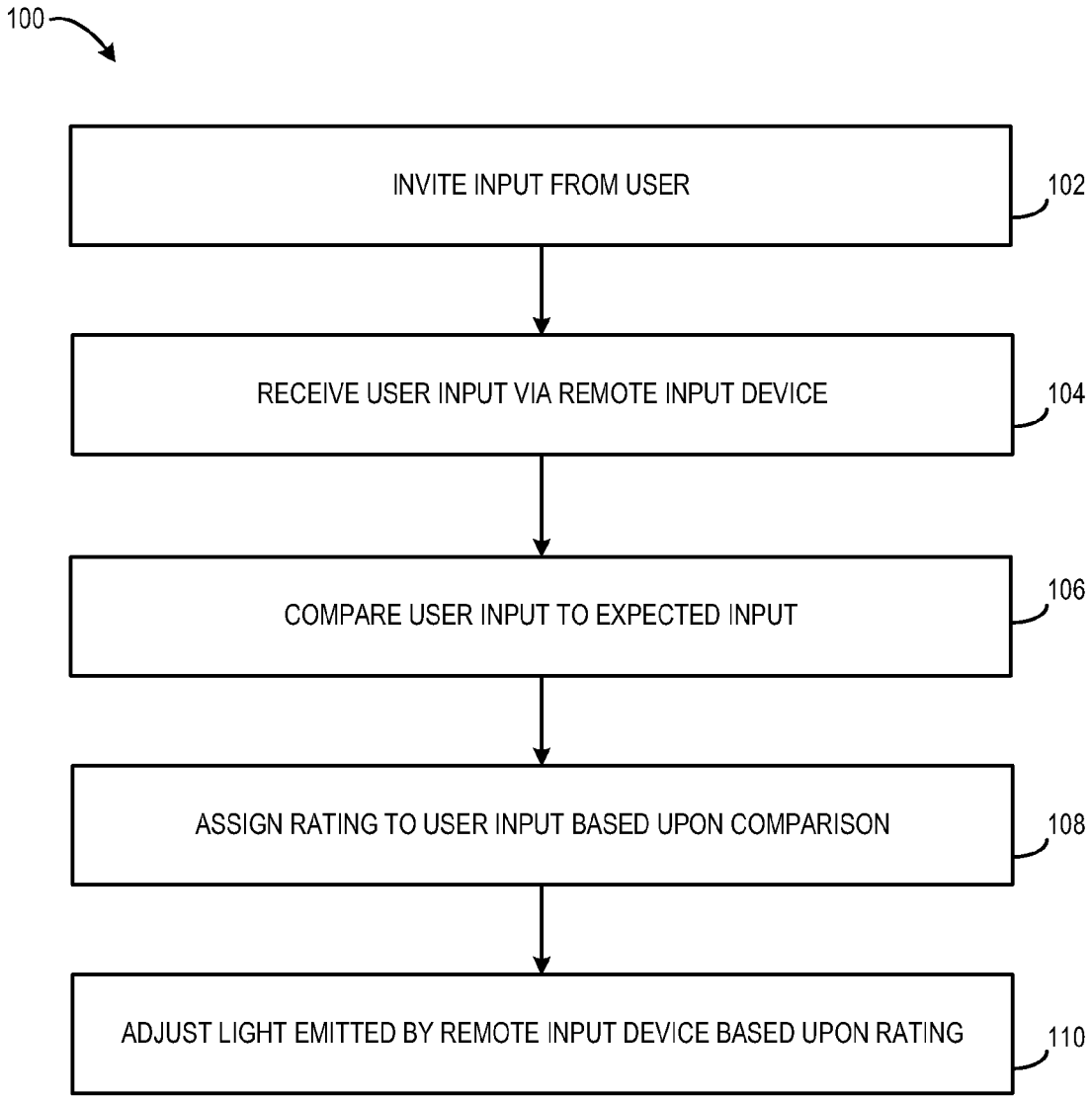
FIG. 1 shows a process flow depicting an embodiment of a method for providing user feedback in an electronic entertainment system.

FIG. 1 shows an embodiment of a method 100 for providing user feedback in an electronic entertainment system. Method 100 comprises, at 102, inviting an input from a user, and then at 104, receiving the input from the user via a hand-held remote input device. In a karaoke system embodiment, the hand-held remote input device may comprise a microphone, while in a video game system embodiment, the hand-held remote input device may comprise a hand-held controller, for example. Next, at 106, method 100 comprises comparing the user input received to an expected user input, and assigning a rating to the user input at 108. Then, at 110, method 100 comprises adjusting light emitted by the remote user input device based upon the rating. Before describing these processes in more detail, it will be understood that, while various embodiments are described herein in the specific context of a karaoke system, other embodiments are not so limited. Further, it will be understood that the term "rating" as used herein refers to any value or values that represents a result of the comparison of the user input against the expected input and that can be used to adjust light emitted by the hand-held remote user input device.

Continuing with FIG. 1, the hand-held remote user input device from which the user input is received may comprise any suitable user input device. For example, in a karaoke system embodiment, the hand-held remote user input device may comprise a microphone with an audio input. Such an audio input may comprise, for example, a receiver/transceiver configured to receive a vocal input and convert the vocal input to an analog audio signal, and also may comprise an analog-to-digital converter to convert the analog audio signal to a digital audio signal. Further, in a karaoke embodiment, the hand-held remote user input device may comprise other performance-based inputs, including but not limited to one or more motion sensors (such as a three-axis accelerometer).

The user input may be compared to the expected input in any suitable manner. For example, where the user input comprises an audio input, comparing the user input to the expected input may comprise comparing one or more musical characteristics of the input, such as a pitch, rhythm, change in intensity (i.e. volume), to those characteristics of the expected input. Further, comparing the user input to the expected input also may comprise using voice recognition techniques to compare the lyrics or language segment sung by the user to an expected language segment. Likewise, where the remote user input device comprises a motion sensor, comparing the user input to an expected input may comprise comparing the output of the motion sensor to an expected output of the motion sensor.

The user input may be compared to the expected input via a local controller located on the hand-held remote input device, or may be sent to an entertainment controller, such as a video game console or karaoke controller console, that executes and controls the electronic interactive entertainment item in use. Where the user input is sent to such an entertainment controller, the input may be sent wirelessly, or via a cable that connects the hand-held remote input device to the entertainment controller.

As mentioned above, any suitable rating may be assigned to the user input based upon the comparison with the expected input. Suitable ratings include any value, values, instructions, etc. capable of causing or instructing the hand-held remote user input device to adjust light emitted by the hand-held remote input device. Further, any suitable factor or combination of factors may be used to assign the rating. For example, in some embodiments, the rating may represent a comparison of a single characteristic of the user input (such as pitch or tone of a vocal input) to a single characteristic of the expected input. In other embodiments, the rating may represent a combination of factors, including but not limited to a combination of characteristics found in a single type of input (e.g. pitch, rhythm, and/or relative intensity of a vocal input), and/or a combination of signals from different inputs (e.g. vocal input combined with gesture input from motion sensor). It will be understood that the rating may be calculated in any suitable manner from these inputs, including but not limited to various statistical methods.

Continuing with FIG. 1, any suitable property of a light emitted by the hand-held remote input device may be adjusted based upon the rating. For example, in some embodiments, the hand-held remote input device may comprise a plurality of light sources of different colors, and optics that distribute light from the light sources to various outlets on the hand-held remote input device. For example, in one specific embodiment, a karaoke microphone may comprise a plurality of colored light-emitting diodes (LEDs), and one or more internal reflection elements such as light pipes that distribute the light to one or more outlets located along the body of the microphone. An intensity of light that is output by each LED may be controlled by the local controller located on the microphone. In this configuration, light output by the microphone may be adjusted in many different ways.

For example, the microphone may be configured to change the color of emitted light depending upon how closely the user input matches the expected input. In one specific example embodiment, light of one color may represent a good vocal and/or gesture performance while light of another color may represent a poor vocal and/or gesture performance. Depending upon how closely the user's vocal and/or gesture performance matches the expected performance, the light output by the microphone may change, either abruptly or along a continuum, between the two colors, or even between more than two colors, by adjusting a relative intensity a first color and a second color. In another specific example embodiment, the microphone may be configured to output a "light show" as long as the input meets a predefined threshold relative to the expected input. If the user input does not meet the predefined threshold relative to the expected input, the microphone may change the output to a different predefined output or output pattern indicating that the user did not match the performance closely enough. It will be understood that these embodiments are described for the purpose of example, and are not intended to be limiting in any manner.

Figure 2:
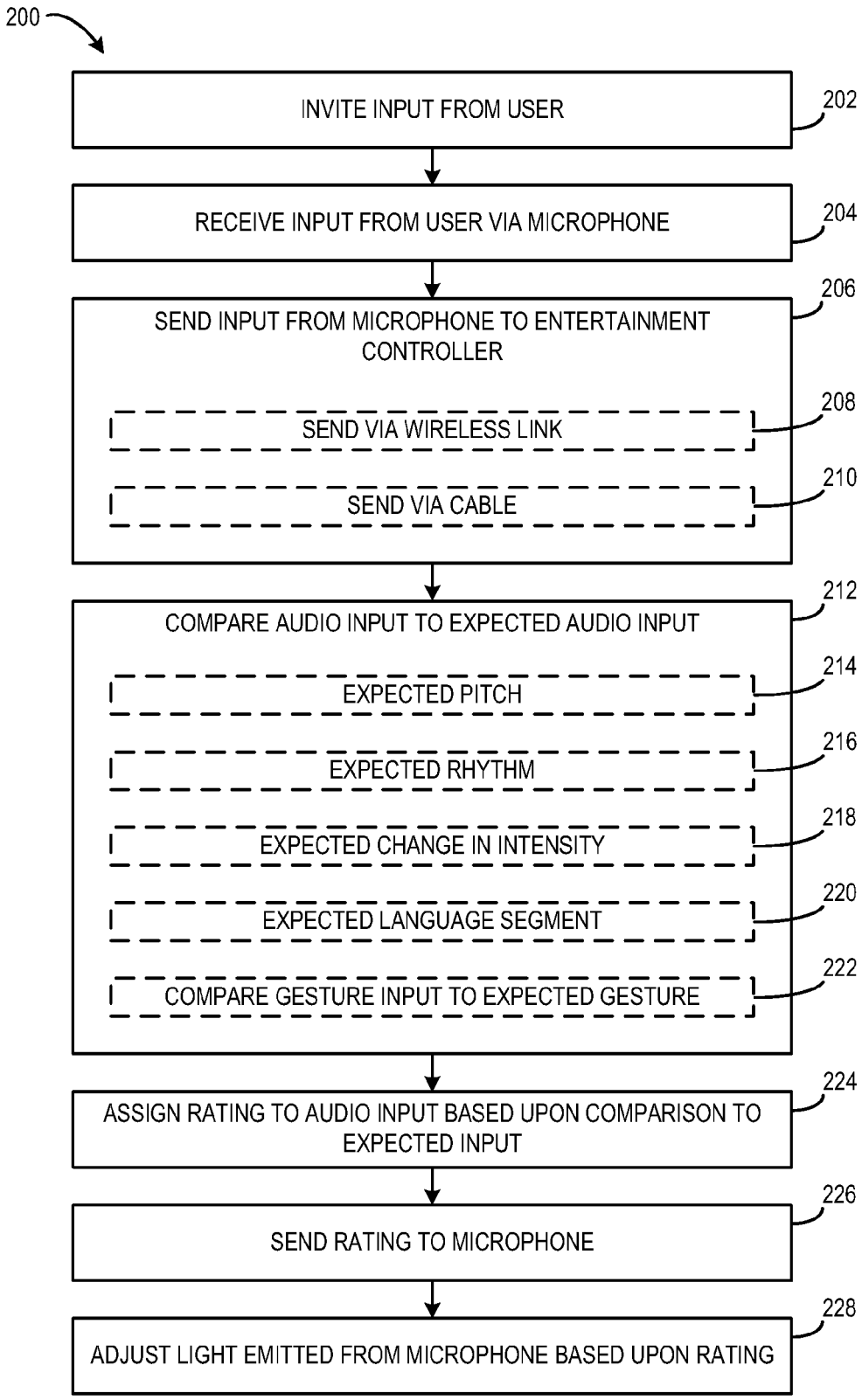
FIG. 2 shows a process flow depicting an embodiment of a method for providing user feedback in a karaoke system.

FIG. 2 illustrates a more specific embodiment in the context of a method 200 of providing feedback to a user of a karaoke game. Method 200 comprises, at 202, inviting an audio input from a user, and then, at 204, receiving the audio input from a user via a microphone. Inviting an audio input may comprise, for example, playing an audio version of a song, and also may comprise displaying lyrics for the song and/or a music video on a video display.

Next, method 200 comprises sending the input received from the user to an entertainment controller located remotely from the microphone. The entertainment controller may comprise a computing device configured to control the karaoke activity. The input may be sent to the entertainment controller via a wireless link, as indicated at 208, or via a cable connecting the microphone to the entertainment controller, as indicated at 210. The terms "computing device", "computer" and the like used herein include any device that electronically executes one or more programs, including but not limited to game consoles, personal computers, servers, laptop computers, hand-held devices, microprocessor-based programmable consumer electronics and/or appliances, computer networking devices, etc.

Method 200 next comprises comparing, at 212, the audio input received from the user to an expected audio input. Any suitable characteristic or characteristics of the audio input received from the user may be compared to the expected audio input. For example, as indicated at 214, an instantaneous or averaged pitch of the user input may be compared to an expected instantaneous or averaged pitch. Further, as indicated at 216 at 218 respectively, a rhythm, a timing, or a change in intensity (i.e. crescendo or diminuendo), of the user input may be compared to an expected rhythm, an expected timing, or intensity change. Further, voice recognition techniques may be used to compare a lyrical input received to an expected lyrical input, as indicated at 220. Additionally, where the microphone comprises a motion sensor, a gesture input received may be compared to an expected gesture input, as indicated at 222.

Next, method 200 comprises, at 224, assigning a rating to the audio input based upon the comparison of the input received to the expected input. The rating may comprise any suitable value, values, instructions, etc. that is configured to cause the microphone to adjust emitted light in a manner based upon the comparison of the user input received to the expected input. For example, as described above, the rating may represent a comparison of a single characteristic of the user input (such as pitch or tone of a vocal input) to a single characteristic of the expected input. In other embodiments, the rating may represent a combination of factors, including but not limited to a combination of characteristics found in a single type of input (e.g. pitch, rhythm, and/or relative intensity of a vocal input), and/or a combination of signals from different inputs (e.g. vocal input combined with gesture input from motion sensor). It will be understood that the rating may be calculated in any suitable manner from these inputs, including but not limited to various statistical methods.

Continuing, method 200 next comprises, at 226, sending the rating to the microphone, and then at 228, adjusting light emitted by the microphone based upon the rating. The rating may be sent to the microphone in any suitable manner, including via a wireless connection and/or via a cable connecting the microphone to the entertainment controller. Likewise, light emitted by the microphone may be adjusted in any suitable manner. For example, relative intensities of a first color of light and a second color of light may be adjusted. Alternatively or additionally, any other suitable adjustment may be made. In this manner, a user of the microphone, as well as any audience members, are presented with visual feedback that is related to the relative closeness of the user's audio and/or gesture performance to an expected performance. It will be understood that the specific example of a karaoke system is described for the purpose of example, and that other embodiments are not so limited.

Figure 3:
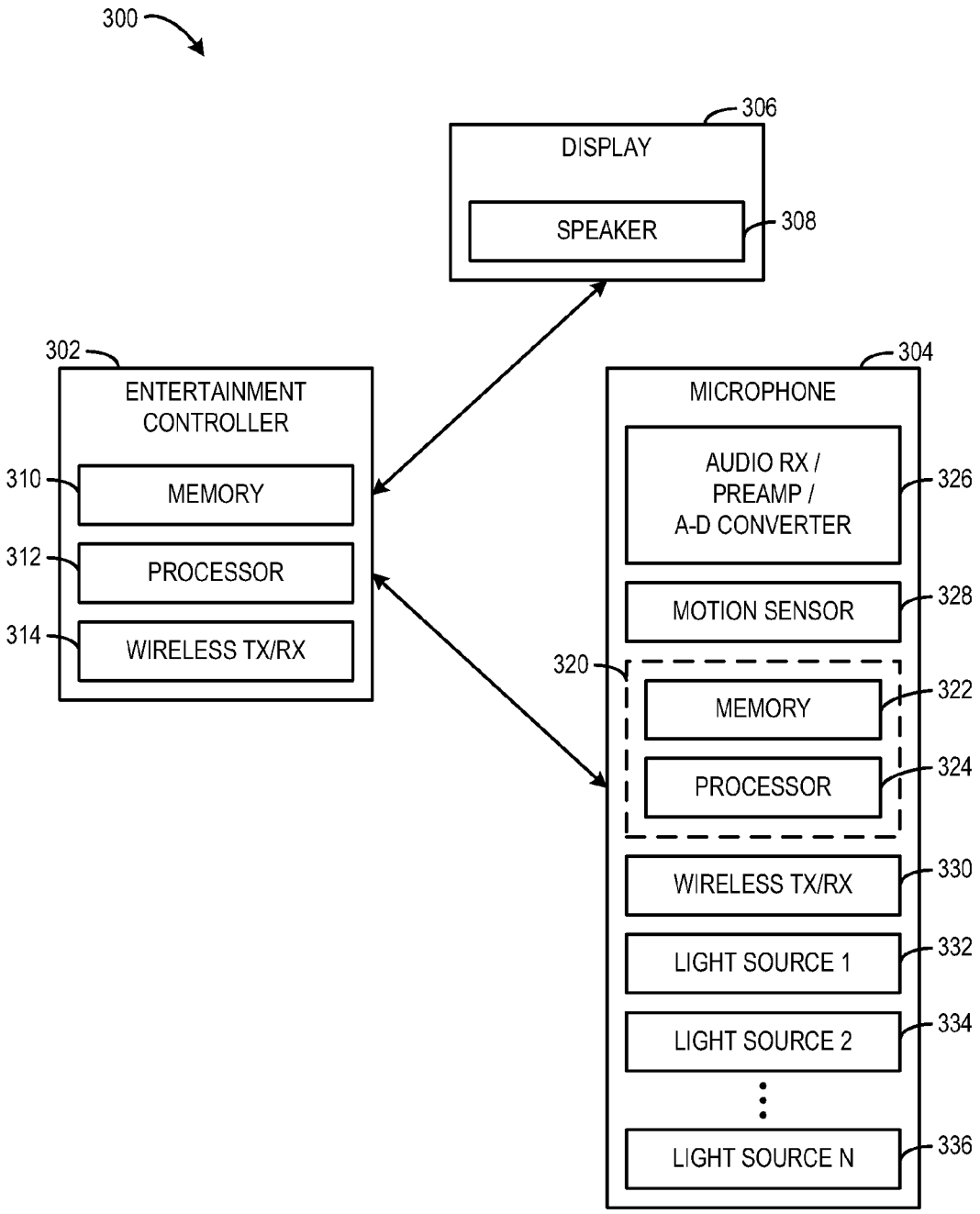
FIG. 3 shows an embodiment of an electronic entertainment system.

FIG. 3 shows an embodiment of an electronic entertainment system in the form of a karaoke system 300. Karaoke system 300 comprises an entertainment controller 302 in communication with a hand-held input device comprising a microphone 304, and with a display system 306. Entertainment controller 302 comprises various components, including but not limited to memory 310, a processor 312, and a wireless transmitter/receiver 314. Entertainment controller 302 is configured to control a presentation of an interactive content item, such as a karaoke game. Thus, the entertainment controller 302 may be configured to control the display of lyrics and/or a music video for a karaoke selection on the display system 306, to control the playback of an audio portion of the karaoke selection via one or more speakers 308 on the display system (or via other speakers located elsewhere in the system), etc. It will be understood that the entertainment controller 302 may communicate with the microphone 304 and the display system 306 wirelessly and/or via one or more cables or the like connecting the devices. Further, it will be appreciated that the entertainment controller, microphone 304 and display system 306 may be connected directly to one another, or may communicate over a network.

The entertainment controller 302 may be configured to communicate with the microphone 304, for example, to receive a user input sent by the microphone 304 or other user input device, to compare the user input to an expected input, to assign a rating based upon the input, and to send the ratings to the microphone 304. In other embodiments, the microphone 304 may be configured to perform the comparison and rating assignment locally.

To enable the performance of such functions, the entertainment controller 302 may comprise programs or code stored in memory 310 and executable by the processor 312. Generally, programs include routines, objects, components, data structures, and the like that perform particular tasks or implement particular abstract data types. The term "program" as used herein may connote a single program or multiple programs acting in concert, and may be used to denote applications, services, or any other type or class of program.

Continuing with FIG. 3, the microphone 304 comprises a microphone controller 320 with memory 322 and a processor 324. The microphone 304 also comprises an audio input 326 configured to receive a vocal input from a user. The audio input 326 may include components such as an audio transducer, a preamp or other amplification stages, an analog-to-digital converter, and/or any other suitable components. The microphone 304 may further comprise one or more motion sensors 328 configured to detect a user gesture, and to provide a signal based upon the gesture to the microphone controller 320 as a gesture input. The microphone 304 further comprises a wireless receiver/transmitter 330 to enable the microphone to communicate wirelessly with the entertainment controller 302. In other embodiments, the microphone 304 may be configured to communicate with the entertainment controller 302 via a cable that connects the microphone 304 to the entertainment controller 302.

The microphone 304 further comprises a plurality of light sources, shown as light source 1, light source 2, and light source n at 332, 334, and 336, respectively. Each light source may comprise any suitable components, including but not limited to light bulbs, LEDs, lasers, as well as various optical components to direct light to outlets located at desired locations on the microphone casing. While shown as having n plural light sources, it will be understood that the microphone 304 may have any suitable number of light sources, including a single light source in some embodiments.

The microphone controller 320 may comprise code stored in memory 322 that is executable by the processor 324 to receive inputs from the various inputs described above, to send such inputs to the entertainment controller, to receive ratings and other communications from the entertainment controller, and to control the output of one or more light sources based upon the rating. Further, as described above, the microphone controller 320 may comprise code executable to compare the user input to the expected input and to assign a rating to the user input based upon this comparison. In such embodiments, it will be understood that the comparison and ratings processes may be performed either fully on the microphone controller 320, or may be shared with the entertainment controller 302 such that the entertainment controller 302 and microphone controller 304 each analyzes a portion of the user input. For example, the entertainment controller 302 may be configured to analyze tone, pitch, rhythm, timing, etc., while the microphone controller 320 may be configured to analyze the volume/intensity of the input. It will be understood that this specific embodiment is described for the purpose of example, and that other embodiments are not so limited.

While described herein in the context of a karaoke system, it will be understood that the concepts disclosed herein may be used in any other suitable environment, including but not limited to video game systems that utilize hand-held remote input devices. It will further be appreciated that the configurations and/or approaches described herein are exemplary in nature, and that these specific embodiments or examples are not to be considered in a limiting sense, because numerous variations are possible. The specific routines or methods described herein may represent one or more of any number of processing strategies such as event-driven, interrupt-driven, multi-tasking, multi-threading, and the like. As such, various acts illustrated may be performed in the sequence illustrated, in parallel, or in some cases omitted. Likewise, the order of any of the above-described processes is not necessarily required to achieve the features and/or results of the embodiments described herein, but is provided for ease of illustration and description. The subject matter of the present disclosure includes all novel and nonobvious combinations and subcombinations of the various processes, systems and configurations, and other features, functions, acts, and/or properties disclosed herein, as well as any and all equivalents thereof.

The invention claimed is:

1. A method of providing user feedback in an electronic entertainment system, the system comprising an entertainment controller and a hand-held remote input device in communication with the entertainment controller, the hand-held remote input device comprising one or more light sources, the method comprising:

inviting an input from a user;

receiving a user input via the remote input device;

performing a comparison of the user input received to an expected input;

assigning a rating to the user input received based upon the comparison to the expected input; and adjusting light emitted by the input device based upon the rating.

2. The method of claim 1, wherein the hand-held remote input device comprises a microphone, and wherein receiving the user input comprises receiving an audio input from a user.

3. The method of claim 1, wherein performing a comparison of the user input to an expected input comprises performing the comparison on the entertainment controller.

4. The method of claim 3, further comprising sending the user input to the entertainment controller via one or more of a wireless connection and a cable.

5. The method of claim 1, wherein the hand-held remote input device comprises a microphone with a local controller, and wherein performing the comparison of the user input to an expected input comprises performing the comparison on the local controller.

6. The method of claim 1, wherein adjusting light emitted by the input device comprises adjusting relative intensities of a first color of light and a second color of light.

7. The method of claim 1, wherein performing the comparison of the user input received to an expected input comprises performing a comparison of one or more of a pitch, a rhythm, a timing, an intensity, and a language segment with an expected pitch, an expected rhythm, an expected timing, an expected intensity and an expected language segment, respectively.

8. A method of providing feedback to a karaoke user, comprising:

inviting an audio input from a user;

receiving the audio input from the user via a microphone;

sending the audio input from the microphone to a entertainment controller;

at the entertainment controller, comparing the audio input from the microphone to an expected audio input;

assigning a rating to the audio input based upon comparing the audio input to the expected audio input;

sending the rating to the microphone; and adjusting light emitted from the microphone based upon the rating.

9. The method of claim 8, further comprising sending the audio input to the entertainment controller wirelessly.

10. The method of claim 8, further comprising sending the audio input to the entertainment server via a cable connecting the microphone to the entertainment controller.

11. The method of claim 8, wherein adjusting light emitted from the microphone comprises adjusting an intensity of one color of light compared to another color of light.

12. The method of claim 8, wherein comparing the audio input to an expected audio input comprises performing a comparison of one or more of a pitch, a rhythm, a timing, an intensity, and a language segment with an expected pitch, an expected rhythm, an expected timing, an expected intensity and an expected language segment, respectively.

* * * * *